United States Patent [19]

Adachi et al.

[11] 4,149,796

[45] Apr. 17, 1979

[54] ELECTROPHOTOGRAPHIC APPARATUS COMPRISING IMPROVED BIAS SOURCE FOR MAGNETIC BRUSH

[75] Inventors: Tsukasa Adachi; Mitsuo Hasebe, both of Tokyo, Japan

[73] Assignee: Ricoh Company, Ltd., Tokyo, Japan

[21] Appl. No.: 764,793

[22] Filed: Feb. 2, 1977

[30] Foreign Application Priority Data

Feb. 7, 1976 [JP] Japan ..... 51-12484
Feb. 7, 1976 [JP] Japan ..... 51-12485
Feb. 9, 1976 [JP] Japan ..... 51-13065

[51] Int. Cl.[2] ..... G03G 15/00; B05B 5/02

[52] U.S. Cl. ..... 355/3 DD; 118/657; 355/16

[58] Field of Search ..... 355/3 R, 3 DD, 16, 3 DR; 118/657

[56] References Cited

U.S. PATENT DOCUMENTS 3,563,734 2/1971 Shely ..... 355/3 R X
3,850,662 11/1974 Jahn ..... 355/3 DD X
3,924,943 12/1975 Fletcher ..... 355/16 X
3,941,472 3/1976 Nagahara et al. ..... 355/3 R X
3,950,089 4/1976 Fraser et al. ..... 355/3 DD
3,980,049 9/1976 Tatsumi et al. ..... 355/10 X

*Primary Examiner*—Fred L. Braun
*Attorney, Agent, or Firm*—Frank J. Jordan

[57] ABSTRACT

A photoconductive sheet is wrappingly attached to an electrically conductive, grounded rotary drum so that part of the drum is covered by the sheet and another part of the drum is exposed. A magnetic brush developing member comprises a magnetic core and an electrically conductive sleeve surrounding the core. An electrically insulative layer is formed on the periphery of the sleeve. The core and/or sleeve are rotated to pick up toner particles which brushingly engage with the sheet to develop an electrostatic image formed thereon. A bias voltage is applied to the sleeve to prevent adherence of toner particles to white areas of the image. A regulator device maintains the bias voltage constant to prevent detrimental effects of charge buildup and dissipation across the electrically insulative layer on the sleeve of the magnetic brush.

4 Claims, 14 Drawing Figures

ELECTROPHOTOGRAPHIC APPARATUS COMPRISING IMPROVED BIAS SOURCE FOR MAGNETIC BRUSH

BACKGROUND OF THE INVENTION

The present invention relates to an electrophotographic apparatus comprising an improved bias voltage source for a magnetic brush development means.

Although a rotary drum having a photoconductive layer formed on the periphery thereof is in widespread use in electrostatic copying machines, the entire drum must be replaced when the photoconductive layer is worn out through prolonged use. This involves considerable maintenance costs since the drum is expensive to manufacture and the replacement operation can be quite time consuming.

For this reason, a photoconductive sheet has been developed which may be wrapped around and attached to a metal drum core or carrier which serves the same function as a photoconductive layer which is vacuum deposited or otherwise formed on the drum. Considerable economies are effected by this arrangement since the sheet is extremely inexpensive to replace compared to an entire drum and the sheet replacement operation may be performed quickly. Generally the sheet does not cover the entire periphery of the drum, and a portion of the metal drum core remains exposed.

It is also currently popular in the electrophotographic art to utilize a magnetic brush as a development means. More specifically, a photoconductive drum is charged and subsequently radiated with a light image of an original document to form an electrostatic image. The magnetic brush applies a toner developing substance to the drum which adheres to high potential areas of the electrostatic image to provide a visible toner image. This toner image is transferred to a copy sheet and fixed thereto to provide a permanent copy of the original document.

The magnetic brush typically comprises a magnetic core and an electrically conductive sleeve surrounding the core. Either or both of the core and sleeve are rotated and the sleeve is partially immersed in the toner substance so that the toner substance adheres to the sleeve and rotates in brushing engagement with the drum to develop the image thereon. An electrically insulative layer is formed on the sleeve to improve image resolution and prevent electrical conduction through any pinholes in the photoconductive layer of the drum. A bias voltage is applied to the sleeve of a magnitude sufficient to prevent adherence of toner to white or background areas of the electrostatic image.

When a drum comprising a metal core and a photoconductive sheet wrapped therearound is combined with the magnetic brush developing means described above, a problem occurs in that the background area near the leading edge of the electrostatic image attracts toner substance so that the background area of the resulting copy will be gray for a distance of several centimeters from the edge corresponding to the leading edge of the image. It is this problem which is overcome by the present invention.

SUMMARY OF THE INVENTION

It has been determined that the cause of the above described problem is charge and discharge across the electrically insulative layer on the sleeve of the magnetic brush. A charging phenomenon occurs when the magnetic brush is in engagement with the exposed portion of the drum core and a discharging phenomenon occurs when the magnetic brush is in engagement with the photoconductive sheet. This causes the bias voltage on the sleeve to be reduced below its proper value as the magnetic brush engages the photoconductive sheet which in turn causes the toner substance to be attracted to the background areas of the image. The bias voltage returns to normal as the discharging phenomenon decreases. This occurs several centimeters from the leading edge of the image. The present invention overcomes this problem by regulating the bias voltage so that the charging and discharging phenomenon will not occur.

It is an object of the present invention to eliminate the cause of gray edges on electrostatic copies.

It is another object of the present invention to provide an electrophotographic apparatus comprising a metal drum, a photoconductive sheet wrapped around the drum and covering a portion thereof and a magnetic brush developing means including a magnetic core, an electrically conductive sleeve surrounding the core and an electrically insulative layer formed on the sleeve in which the bias voltage applied to the sleeve is prevented from fluctuating while the magnetic brush is in engagement with the sheet.

It is another object of the present invention to provide an electrophotographic apparatus comprising an improved biasing means for a magnetic brush developing unit which maintains the bias voltage constant.

It is another object of the present invention to provide an improved electrophotographic apparatus in which a bias voltage source for a magnetic brush comprises a regulator.

It is another object of the present invention to provide a generally improved electrophotographic apparatus.

Other objects, together with the foregoing, are attained in the embodiments described in the following description and illustrated in the accompanying drawing.

DESCRIPTION OF THE PREFERRED EMBODIMENTS

While the electrophotographic apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
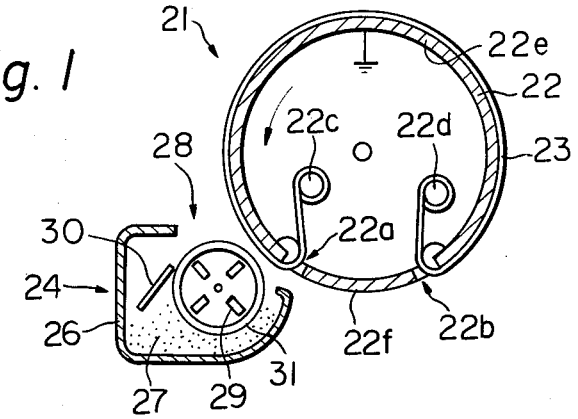
FIG. 1 is a simplified schematic view of an electrophotographic apparatus embodying the present invention.

Referring now to FIG. 1 of the drawing, an electrophotographic copying apparatus embodying the present invention is generally designated by the reference numeral 21 and comprises an electrically conductive, grounded carrier in the form of a rotary metal drum 22. An electrically conductive sheet 23 having a photoconductive surface layer is wrapped around the drum 22 and attached thereto. More specifically, the drum 22 is formed with longitudinal slits 22*a* and 22*b* through which the ends of the sheet 23 are passed and rollers 22*c* and 22*d* around which the ends of the sheet 23 are wound in such a manner that the sheet 23 is firmly attached to the drum 22. In the position of the drum 22 illustrated in FIG. 1, an upper portion 22*e* of the drum 22 is covered by the sheet 23 and a lower portion 22*f* of the drum 22 is exposed. The sheet 23 is typically 25 centimeters wide and the photoconductive layer is constituted by an organic photoconductive material. The drum 22 and sheet 23 are rotated counterclockwise at constant speed in a unitary manner.

A developing unit 24 comprises a developing tank 26 which holds a powdered toner developing substance 27. A magnetic brush 28 which is partially immersed in the toner substance 27 comprises a magnetic core 29 and non-magnetic but electrically conductive sleeve 31 which coaxially surrounds the core 29. Either or both of the core 29 and sleeve 31 are rotated so that the toner substance 27 adheres to the sleeve 31 in the form of a brush which rotates in brushing engagement with the sheet 23 and the exposed portion 22*f* of the drum 22 depending on the rotational position of the drum 22. Also shown in the drawing is a doctor blade 30 which removes excess toner substance from the sleeve 31 upon counterclockwise rotation of the toner substance 27 adhered thereto.

In operation, the sheet 23 is uniformly charged and subsequently radiated with a light image of an original document although the means for performing these operations are not the subject matter of the present invention and are not shown. The light image causes localized photoconduction in the photoconductive layer of the sheet 23 and the formation of an electrostatic image thereof. Upon engagement of the electrostatic image with the magnetic brush 28, the toner substance 27 adheres to the high potential areas of the electrostatic image which correspond to the dark areas of the original document so that a visible toner image is developed on the sheet 23. This toner image is transferred to a copy sheet and fixed thereto to provide a permanent copy although the means for performing these operations are likewise not shown.

Figure 2:
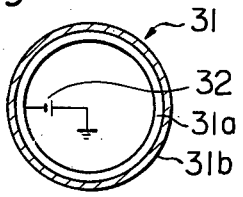
Fig. 2 PRIOR ART
FIG. 2 is a schematic view of part of a prior art magnetic brush developing means and a bias voltage source therefor.

Preferably, a bias voltage is applied to the sleeve 31 of a polarity and magnitude to prevent adherence of the toner substance 27 to the white or background areas of the electrostatic image on the sheet 23. A prior art means for producing this bias voltage is shown in FIG. 2 in the form of a bias voltage source symbolized by a battery 32 which is connected to the sleeve 31. In order to prevent current flow through pinholes in the photoconductive layer of the sheet 23, the sleeve 31 is constituted by an electrically conductive core 31*a* and an electrically insulative layer 31*b* formed on the periphery of the core 31*a*. The battery 32 is connected to the core 31*a*. However, this prior art arrangement introduces a problem which will be discussed with reference to FIGS. 3 to 6.

Figure 3:
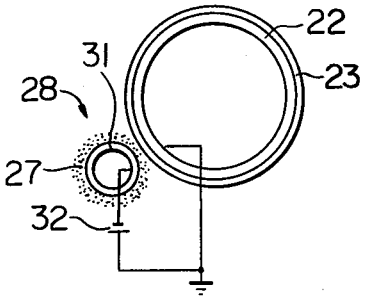
Fig. 3 PRIOR ART
FIG. 3 is a schematic view illustrating the electrical circuit constituted by a prior art magnetic brush, bias voltage source and a photoconductive drum.
Figure 4:
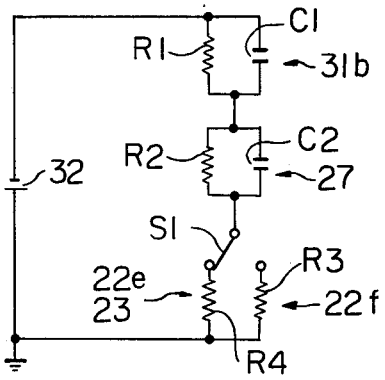
Fig. 4 PRIOR ART
FIG. 4 is an electrical schematic diagram illustrating the equivalent circuit of FIG. 3.

FIG. 3 illustrates the physical arrangement of an electrical circuit constituted by the battery 32, magnetic brush 28, drum 22 and sleeve 31 and FIG. 4 shows the equivalent circuit of the arrangement. More specifically, the insulative layer 31*b* of the sleeve 31 is represented as a resistor R1 in parallel with a capacitor C1 in FIG. 4. The toner substance 27 on the sleeve 31 which contacts both the insulative layer 31*b* and the sheet 23 or exposed portion 22*f* of the drum 22 is represented by a resistor R2 in parallel with a capacitor C2. The exposed portion 22*f* of the drum 22 is represented by a resistor R3 and the series combination of the covered portion 22*e* of the drum 22 and the sheet 23 is represented by a resistor R4. A switch S1 represents the engagement of the toner substance 27 with either the sheet 23 or exposed portion 22*f* of the drum 22 which occurs upon rotation of the drum 22. The capacitor C1 has a much higher value than the capacitor C2 and the resistor R1 has a much greater value than the resistor R2. Also, the resistor R4 has a much greater value than the resistor R3.

Figure 5:
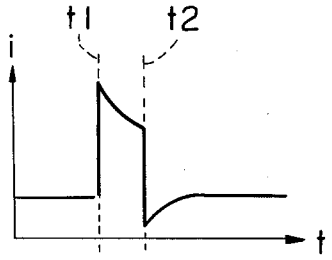
Fig. 5 PRIOR ART
FIG. 5 is a graph illustrating the current flow through the circuit of FIG. 4 as a function of time.
Figure 6:
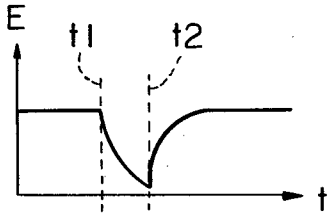
Fig. 6 PRIOR ART
FIG. 6 is a graph illustrating the bias voltage for the circuit of FIG. 4 as a function of time.

FIGS. 5 and 6 show the relationship between the current i and the voltage E respectively at the movable contact of the switch S1, the voltage E representing the bias voltage applied to the sheet 23 or exposed portion 22*f* of the drum 22 through the toner substance 27 from the sleeve 31, with respect to time t upon rotation of the drum 22. Prior to a time t1 the toner substance 27 contacts the sheet 23 (the switch S1 connects the resistor R2 to the resistor R4). Since the resistance of the resistor R4 is high compared to the resistance of the resistor R3, the current flow through the switch S1 is low.

When the drum 22 has rotated such that the toner substance 27 contacts the exposed portion 22*f* of the drum 22 at the time t1, (the switch S1 connects the resistor R2 to the resistor R3), the current flow through the switch S1 increases due to the reduced resistance in the circuit. The initial current flow through the capacitor C1 is high which contributes significantly to the high initial total current flow. However, as the capacitor C1 charges, the current flow decreases. The bias voltage decreases as shown in FIG. 6 in a manner dependent on the charging rate of the capacitor C1.

When the toner substance 27 contacts the leading edge of the sheet 23 at a time t2, (the switch S1 again connects the resistor R2 to the resistor R4) the resistance in the circuit is again increased and the voltage across the resistor R1 is decreased. This causes the capacitor C1 to discharge in such a manner that the voltage across the capacitor C1 and the discharge current through the capacitor C1 oppose the voltage and current in the remainder of the circuit. As the capacitor C1 discharges, the bias voltage increases to the proper value which existed before the time t1. However, this takes a period of time determined by the time constant of the capacitor C1 and the resistance in the circuit. Generally, the proper bias voltage will be resorted after the leading edge of the sheet 23 has passed the toner substance 27 on the sleeve 31 by several centimeters. However, during this time the bias voltage will be reduced to such an extent that it is insufficient to prevent adherence of toner substance 27 to the background areas of the electrostatic image resulting in a gray edge on the copy.

Figure 7:
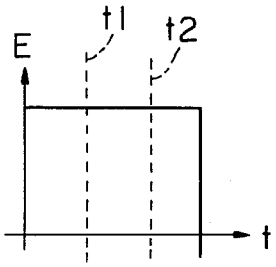
FIG. 7 is a graph illustrating the bias voltage as a function of time for an improved apparatus embodying the present invention.
Figure 8:
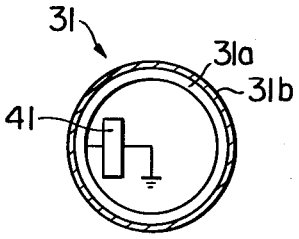
FIG. 8 is similar to FIG. 2 but illustrates an improved bias voltage source embodying the present invention.

This problem is overcome by means of a constant current source 41 shown in FIG. 8 which replaces the battery 32. The constant current source 41 may comprise a voltage source and a solid state current regulator of any type which is well known in the art. By ensuring that the current flow through the circuit is constant, the bias voltage will be constant at all times as shown in the graph of FIG. 7. In this manner, gray edges on copies are positively eliminated. In order to ensure that dark areas of copies of original documents having large dark image areas will not be washed out, the constant current source may be adapted to also function as a constant voltage source. In this case, the constant current source would function as a constant current source at voltages below a predetermined level and as a constant voltage source at currents below a predetermined level. Typically, the bias voltage will be maintained between 150V and 250V with 250V as the normal level.

Figure 9:
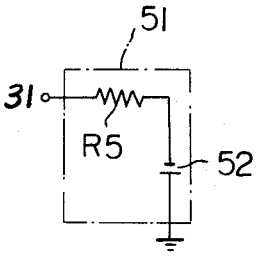
FIG. 9 is an electrical schematic diagram showing a first embodiment of the improved bias voltage source.

One embodiment of the constant current source 41 is shown in FIG. 9 and designated as 51. The constant current source 51 comprises a voltage source symbolized by a battery 52 and a resistor R5 connected between the battery 52 and the sleeve 31. The resistor R5 is selected to have an extremely large value compared to the value of the resistor R4 so that only a very small variation in current will occur when the switch S1 is switched between the resistors R3 and R4. In this manner, the capacitor C1 charges and discharges by only a small amount and the variation in the bias voltage is negligible. Where the photoconductive layer of the sheet 23 comprises alumite and the insulating layer 31*b* on the sleeve 31 comprises alumite impregnated with TEFLON (tradename), the value of the resistor R5 should be selected between 20 million ohms and 50 million ohms.

Figure 10:
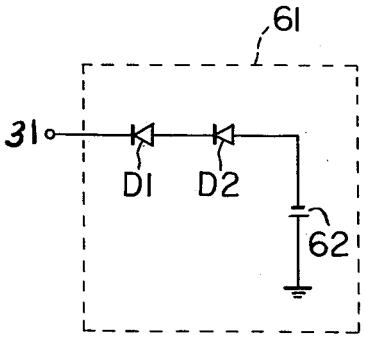
FIG. 10 is similar to FIG. 9 but shows a second embodiment of the improved bias voltage source.

FIG. 10 shows another embodiment of the constant current source which is designated as 61 and comprises a battery 62. Two diodes D1 and D2 are connected in series between the battery 62 and the sleeve 31. Since the battery 62 is shown by way of example with its positive terminal grounded, the anode of the diode D2 is connected to the negative terminal of the battery 62 and the cathode of the diode D2 is connected to the anode of the diode D1. In this manner, the diodes D1 and D2 are reverse biased and the only current which flows through the circuit is the reverse leakage current of the diodes D1 and D2. This reverse leakage current tends to be constant, and the diodes D1 and D2 constitute a constant current source.

Figure 14:
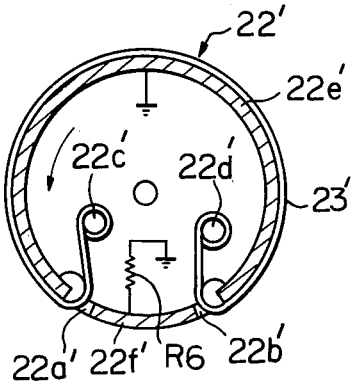
FIG. 14 is a simplified schematic view of an electrophotographic apparatus showing another embodiment of the present invention.

Another embodiment of the invention is shown in FIG. 14 in which like elements are designated by the same reference numerals suffixed by an apostrophe. In this embodiment, a portion 22*e*′ of a drum 22′ which is covered by a photoconductive sheet 23′ is electrically isolated from a portion 22*f*′ of the drum 22′ which is exposed. The portion 22*e*′ is directly grounded and the portion 22*f*′ is grounded through a resistor R6. The value of the resistor R6 is selected so that the resistance of the sheet 23′ and portion 22*e*′ of the drum 22 in series is equal to the resistance of the portion 22*f*′ of the drum 22′ and the resistor R6 in series. This has the effect of making the resistor R3 in FIG. 4 equal to the resistor R4. Therefore, there is no change in current flow in the circuit when the toner substance 27 contacts the sheet 23′ and the exposed portion 22*f*′ in sequence. The charge across the capacitor C1 does not change and the bias voltage is maintained constant as shown in FIG. 7. The value of the resistor R6 is typically between 50 million ohms and 100 million ohms.

Figure 11:
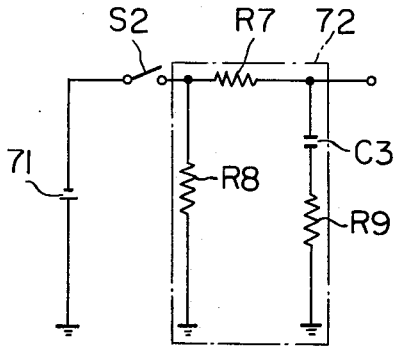
FIG. 11 is similar to FIG. 9 but shows a third embodiment of the improved bias voltage source.
Figure 12:
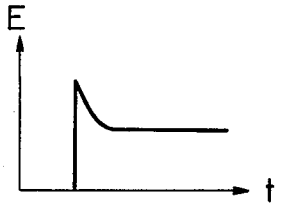
FIG. 12 is a graph showing the bias voltage where the bias voltage source of FIG. 11 is not provided with an integrating circuit.
Figure 13:
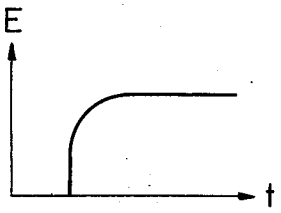
FIG. 13 is a graph showing the function of the integrating circuit of the bias voltage source of FIG. 11.

Yet another embodiment of the present invention is shown in FIG. 11. In this embodiment the bias voltage is produced by a bias voltage source symbolized by a battery 71. A switch S2 is mechanically actuated by rotation of the drum 22 to connect the battery 71 to the sleeve 31 through a resistor R7 only while the toner substance 27 contacts the sheet 23. However, another problem is introduced by this method in that the bias voltage is excessively high as shown in FIG. 12 when the switch S2 is first closed due to high current flow through the circuit caused by charging of the capacitor C1. This results in the leading edge of the copy to appear washed out. To overcome this problem, a constant current regulator 72 of which the resistor R7 constitutes a component part is designed as an integrating circuit. More specifically, a resistor R8 is connected between the junction of the switch S2 and resistor R7 and ground. A capacitor C3 is connected at one end thereof to the other end of the resistor R7 and at the other end thereof to ground through a resistor R9. The resistors R7, R8 and R9 and capacitor C3 are selected to have a time constant complimentary to the time constant of the capacitor C1 and associated resistors. The voltage at the junction of the resistor R7 and capacitor C3 after the switch S2 is closed is shown in FIG. 13. Since the capacitor C3 charges through the resistors R7 and R9, the regulator 72 constitutes an integrating circuit. When the curves of FIGS. 12 and 13 are combined, the resultant bias voltage is constant as shown in FIG. 7.

In summary, the present invention overcomes the problem of gray edges of copies caused by the charge and discharge across an insulating layer on a sleeve of a magnetic brush developing means in an electrophotographic apparatus. The regulator utilized to perform this function may be embodied in a number of different ways, several of which are disclosed herein and others which will become apparent to those skilled in the art after receiving the teachings of the present disclosure without departing from the scope thereof. Although the present invention has been described with reference to a dry development process, it is also applicable to a cascade or semi-moist developing process. In addition, although the present invention has been described as comprising a drum covered partially with a photoconductive sheet, it may be further adapted to an electrophotographic apparatus comprising a drum which is covered on its entire periphery with a photoconductive layer and a bias voltage source is energized only when the magnetic brush is in contact with an image area of the photoconductive layer of the drum.

What is claimed is:

1. An electrophotographic apparatus comprising:

a photoconductive means including an electrically conductive, grounded rotary carrier and a photoconductive sheet attached to the periphery of the carrier, the sheet covering a first portion of the carrier, a magnetic brush developing means brushingly engaging with the sheet and a second exposed portion of the carrier upon rotation of the photoconductive means; and bias means comprising a bias voltage source and a regulator means for applying a bias voltage to the developing means in such a manner that the bias voltage is maintained substantially constant;

the first portion of the carrier being electrically isolated from the second portion of the carrier, the first portion of the carrier being directly grounded and the second portion of the carrier being grounded through a resistor having a value selected such that the electrical resistance between the second portion of the carrier and ground is equal to the electrical resistance between the sheet and ground.

2. An apparatus according to claim 1, in which the resistor has a value between 50 million ohms and 100 million ohms.

3. An electrophotographic apparatus comprising:

a photoconductive means including an electrically conductive, grounded rotary carrier and a photoconductive sheet attached to the periphery of the carrier, the sheet covering a first portion of the carrier;

a magnetic brush developing means brushingly engaging with the sheet and a second exposed portion of the carrier upon rotation of the photoconductive means; and bias means comprising a bias voltage source and a regulator means for applying a bias voltage to the developing means in such a manner that the bias voltage is maintained substantially constant, the regulator means comprising a reverse biased diode connected between the voltage source and the developing means.

4. An electrophotographic apparatus comprising:

a photoconductive means including an electrically conductive grounded rotary carrier and a photoconductive sheet attached to the periphery of the carrier, the sheet covering a first portion of the carrier;

a magnetic brush developing means brushingly engaging with the sheet and a second portion of the carrier upon rotation of the photoconductive means; and bias means comprising a bias voltage source and a regulator means for applying a bias voltage to the developing means in such a manner that the bias voltage is maintained substantially constant, the regulator means comprising an integrating circuit connected between the voltage source and the developing means and a switch connected between the voltage source and the integrating circuit for connecting the voltage source to the integrating circuit only when the developing means is in engagement with the sheet.

* * * * *